US009437909B2

(12) United States Patent
Vangala et al.

(10) Patent No.: US 9,437,909 B2
(45) Date of Patent: Sep. 6, 2016

(54) DIELECTRIC WAVEGUIDE FILTER WITH DIRECT COUPLING AND ALTERNATIVE CROSS-COUPLING

(71) Applicants: Reddy Vangala, Albuquerque, NM (US); Nam Phan, Rio Rancho, NM (US)

(72) Inventors: Reddy Vangala, Albuquerque, NM (US); Nam Phan, Rio Rancho, NM (US)

(73) Assignee: CTS Corporation, Elkhart, IN (US)

( * ) Notice: Subject to any disclaimer, the term of this patent is extended or adjusted under 35 U.S.C. 154(b) by 0 days.

(21) Appl. No.: 14/842,946

(22) Filed: Sep. 2, 2015

(65) Prior Publication Data

US 2016/0087322 A1 Mar. 24, 2016

Related U.S. Application Data

(63) Continuation of application No. 14/490,284, filed on Sep. 18, 2014, now Pat. No. 9,130,258.

(51) Int. Cl.

| | |
|---|---|
| ***H01P 1/20*** | (2006.01) |
| ***H01P 7/10*** | (2006.01) |
| ***H01P 1/208*** | (2006.01) |

(52) U.S. Cl.

CPC ..... *H01P 1/2002* (2013.01); *H01P 1/2088* (2013.01); *H01P 7/10* (2013.01)

(58) Field of Classification Search

CPC ..... H01P 1/2002; H01P 7/10; H01P 1/2088
USPC ..... 333/202–212, 219.1
See application file for complete search history.

(56) References Cited

U.S. PATENT DOCUMENTS

| | | | |
|---|---|---|---|
| 3,882,434 | A | 5/1975 | Levy |
| 3,955,161 | A | 5/1976 | MacTurk |
| 4,396,896 | A | 8/1983 | Williams |

(Continued)

FOREIGN PATENT DOCUMENTS

| | | | |
|---|---|---|---|
| CN | 201898182 | U | 7/2011 |
| CN | 102361113 | A | 2/2012 |

(Continued)

OTHER PUBLICATIONS

Ruiz-Cruz J et al: "Rectangular Waveguide Elliptic Filters with Capacitive and Inductive Irises and Integrated Coaxial Excitation", 2005 IEEE MTT-S International Microwave Symposium, Piscataway, NJ, USA, IEEE, (Jun. 12, 2005) pp. 269-272, EP010844740, DOI: 10.1109/MWSYM.2005.1516577, ISBN: 978-0-7803-8846-8 p. 269; figures 1,3.

(Continued)

*Primary Examiner* — Robert Pascal
*Assistant Examiner* — Rakesh Patel
(74) *Attorney, Agent, or Firm* — Daniel Deneufbourg

(57) ABSTRACT

A waveguide filter comprising a base block of dielectric material defining at least first and second resonators and a bridge block seated on top of the base block and defining at least a third resonator. In one embodiment, the base block comprises first and second base blocks that have been coupled together in an end to end relationship. An external transmission line or an interior RF signal transmission window or an RF signal transmission bridge provides a cross-coupling RF signal transmission path between the first and second resonators. At least first and second interior RF signal transmission windows provide a direct RF signal transmission path between the first and third resonators and the second and third resonators respectively.

3 Claims, 5 Drawing Sheets

(56) References Cited

U.S. PATENT DOCUMENTS

| | | | |
|---|---|---|---|
| 4,431,977 | A | 2/1984 | Sokola et al. |
| 4,609,892 | A | 9/1986 | Higgins, Jr. |
| 4,692,726 | A | 9/1987 | Green et al. |
| 4,706,051 | A | 11/1987 | Dieleman et al. |
| 4,733,208 | A | 3/1988 | Ishikawa et al. |
| 4,742,562 | A | 5/1988 | Kommrusch |
| 4,800,348 | A | 1/1989 | Rosar et al. |
| 4,806,889 | A | 2/1989 | Nakano et al. |
| 4,837,535 | A | 6/1989 | Konishi et al. |
| 4,940,955 | A | 7/1990 | Higgins, Jr. |
| 4,963,844 | A | 10/1990 | Konishi et al. |
| 4,996,506 | A | 2/1991 | Ishikawa et al. |
| 5,004,992 | A | 4/1991 | Grieco et al. |
| 5,023,944 | A | 6/1991 | Bradley |
| 5,130,682 | A | 7/1992 | Agahi-Kesheh |
| 5,208,565 | A | 5/1993 | Sogo et al. |
| 5,243,309 | A | 9/1993 | L'Ecuyer |
| 5,285,570 | A | 2/1994 | Fulinara |
| 5,288,351 | A | 2/1994 | Hoang et al. |
| 5,365,203 | A | 11/1994 | Nakamura et al. |
| 5,382,931 | A | 1/1995 | Piloto et al. |
| 5,416,454 | A | 5/1995 | McVeety |
| 5,525,946 | A | 6/1996 | Tsujiguchi et al. |
| 5,528,204 | A | 6/1996 | Hoang et al. |
| 5,528,207 | A | 6/1996 | Ito |
| 5,537,082 | A | 7/1996 | Tada et al. |
| 5,572,175 | A | 11/1996 | Tada et al. |
| 5,602,518 | A | 2/1997 | Clifford, Jr. et al. |
| 5,719,539 | A | 2/1998 | Ishizaki et al. |
| 5,731,751 | A | 3/1998 | Vangala |
| 5,821,836 | A | 10/1998 | Katehi et al. |
| 5,850,168 | A | 12/1998 | McVeety et al. |
| 5,926,078 | A | 7/1999 | Hino et al. |
| 5,926,079 | A | 7/1999 | Heine et al. |
| 5,929,726 | A | 7/1999 | Ito et al. |
| 5,999,070 | A | 12/1999 | Endo |
| 6,002,306 | A | 12/1999 | Arakawa et al. |
| 6,023,207 | A | 2/2000 | Ito et al. |
| 6,026,281 | A | 2/2000 | Yorita |
| 6,137,383 | A | 10/2000 | De Lillo |
| 6,154,106 | A | 11/2000 | De Lillo |
| 6,160,463 | A | 12/2000 | Arakawa et al. |
| 6,181,225 | B1 | 1/2001 | Bettner |
| 6,255,921 | B1 | 7/2001 | Arakawa et al. |
| 6,281,764 | B1 | 8/2001 | Arakawa et al. |
| 6,329,890 | B1 | 12/2001 | Brooks et al. |
| 6,351,198 | B1 | 2/2002 | Tsukamoto et al. |
| 6,437,655 | B1 | 8/2002 | Andoh et al. |
| 6,504,446 | B1 | 1/2003 | Ishihara et al. |
| 6,535,083 | B1 | 3/2003 | Hageman et al. |
| 6,549,095 | B2 | 4/2003 | Tsukamoto et al. |
| 6,559,740 | B1 | 5/2003 | Schulz et al. |
| 6,568,067 | B2 | 5/2003 | Takeda |
| 6,594,425 | B2 | 7/2003 | Tapalian et al. |
| 6,677,837 | B2 | 1/2004 | Kojima et al. |
| 6,757,963 | B2 | 7/2004 | Meier et al. |
| 6,791,403 | B1 | 9/2004 | Tayrani et al. |
| 6,801,106 | B2 | 10/2004 | Ono et al. |
| 6,834,429 | B2 | 12/2004 | Blair et al. |
| 6,844,861 | B2 | 1/2005 | Peterson |
| 6,888,973 | B2 | 5/2005 | Kolodziejski et al. |
| 6,900,150 | B2 | 5/2005 | Jacquin et al. |
| 6,909,339 | B2 | 6/2005 | Yonekura et al. |
| 6,909,345 | B1 | 6/2005 | Salmela et al. |
| 6,927,653 | B2 | 8/2005 | Uchimura et al. |
| 6,977,560 | B2 | 12/2005 | Iroh et al. |
| 6,977,566 | B2 | 12/2005 | Fukunaga |
| 7,009,470 | B2 | 3/2006 | Yatabe et al. |
| 7,068,127 | B2 | 6/2006 | Wilber et al. |
| 7,132,905 | B2 | 11/2006 | Sano |
| 7,142,074 | B2 | 11/2006 | Kim et al. |
| 7,170,373 | B2 | 1/2007 | Ito et al. |
| 7,271,686 | B2 | 9/2007 | Yoshikawa et al. |
| 7,323,954 | B2 | 1/2008 | Lee et al. |
| 7,449,979 | B2 | 11/2008 | Koh et al. |
| 7,545,235 | B2 | 6/2009 | Mansour et al. |
| 7,659,799 | B2 | 2/2010 | Jun et al. |
| 7,714,680 | B2 | 5/2010 | Vangala et al. |
| 8,008,993 | B2 | 8/2011 | Milson et al. |
| 8,072,294 | B2 | 12/2011 | Tanpo et al. |
| 8,171,617 | B2 | 5/2012 | Vangala |
| 8,284,000 | B2 | 10/2012 | Fukunaga |
| 8,314,667 | B2 | 11/2012 | Uhm et al. |
| 8,823,470 | B2 | 9/2014 | Vangala |
| 9,130,255 | B2 | 9/2015 | Rogozine et al. |
| 9,130,256 | B2 | 9/2015 | Rogozine et al. |
| 9,130,257 | B2 | 9/2015 | Vangala |
| 9,130,258 | B2 | 9/2015 | Vangala et al. |
| 2001/0024147 | A1 | 9/2001 | Arakawa et al. |
| 2002/0024410 | A1 | 2/2002 | Guglielmi et al. |
| 2003/0006865 | A1 | 1/2003 | Kim et al. |
| 2004/0000968 | A1 | 1/2004 | White et al. |
| 2004/0056737 | A1 | 3/2004 | Carpintero et al. |
| 2004/0129958 | A1 | 7/2004 | Kho et al. |
| 2004/0257194 | A1 | 12/2004 | Casey et al. |
| 2005/0057402 | A1 | 3/2005 | Ohno et al. |
| 2007/0120628 | A1 | 5/2007 | Jun et al. |
| 2009/0015352 | A1 | 1/2009 | Goebel et al. |
| 2009/0102582 | A1 | 4/2009 | Van Der Heijden et al. |
| 2009/0146761 | A1 | 6/2009 | Nummerdor |
| 2009/0201106 | A1 | 8/2009 | Iio et al. |
| 2009/0231064 | A1 | 9/2009 | Bates et al. |
| 2010/0024973 | A1 | 2/2010 | Vangala |
| 2010/0253450 | A1 | 10/2010 | Kim et al. |
| 2011/0279200 | A1 | 11/2011 | Vangala |
| 2012/0229233 | A1 | 9/2012 | Ito |
| 2012/0286901 | A1 | 11/2012 | Vangala |
| 2013/0214878 | A1 | 8/2013 | Gorisse et al. |

FOREIGN PATENT DOCUMENTS

| | | | |
|---|---|---|---|
| DE | 102008017967 | A1 | 10/2009 |
| EP | 0322993 | A2 | 7/1989 |
| EP | 0322993 | A3 | 4/1990 |
| EP | 0444948 | A2 | 3/1991 |
| EP | 0757401 | A2 | 2/1997 |
| EP | 0859423 | A1 | 8/1998 |
| EP | 1024548 | A1 | 2/2000 |
| EP | 0997964 | A2 | 5/2000 |
| EP | 0997964 | A3 | 9/2001 |
| EP | 1439599 | A1 | 7/2004 |
| FR | 2318512 | A1 | 2/1977 |
| JP | 62038601 | | 2/1987 |
| JP | 2003298313 | | 10/2003 |
| JP | 2006157486 | | 6/2006 |
| WO | 9509451 | | 4/1995 |
| WO | 0024080 | | 4/2000 |
| WO | 0038270 | A1 | 6/2000 |
| WO | 2005091427 | | 9/2005 |

OTHER PUBLICATIONS

Paul Wade: "Rectangular Waveguide to Coax Transition Design", QEX, Nov./Dec. 2006, pp. 10-17, published by American Radio Relay League, Newington, Connecticut, US.

Yoji Isota, Moriyasu Miyazaki, Osami Ishida, Fumio Takeda, Mitsubishi Electric Corporation. "A Grooved Monoblock Comb-Line Filter Suppressing the Third Harmonics", IEEE 1987 MTT-S Digest, pp. 383-386, published by IEEE, New York, New York, US.

C. Choi, Fig. 2.13, Monolithic Plated Ceramic Waveguide Filters, Mar. 31, 1986, Motorola, Inc., Schaumburg, Illinois, U.S.

Kocbach J. et al: "Design Procedure for Waveguide Filters with Cross-Couplings", 2002 IEEE MTT-S International Microwave Symposium Digest (Cat. No. 02CH37278) IEEE Piscataway, NJ, USA; IEEE MTT-S International Microwave Symposium, IEEE, Jun. 2, 2002, pp. 1449-1452, XP001113877, DOI: 10.1109/WMSYM.2002.1012128 ISBN: 978-0-8703-7239-9 abstract; figure 1.

N. Marcuvitz, Waveguide Handbook, McGraw-Hill Book Co., New York City, Ch. 5, 1951.

Y. Konishi, "Novel dielectric waveguide components-microwave applications of new ceramic materials," Proc. IEEE, vo. 79, pp. 726-740, Jun. 1991.

(56) References Cited

OTHER PUBLICATIONS

K. Sano, "Dielectric waveguide filter with low profile and low insertion loss," IEEE Trans. on Microwave Theory & Tech., vol. 47, pp. 2299-2303, Dec. 1999.

K. Sano and T. Yoneyama, "A transition from Microstrip to Dielectric Filled Rectangular Waveguide in Surface Mounting," IEEE MTT-S Int. Microwave Symp. Digest, pp. 813-816, 2002.

I. Awai, A.C. Kundu, and T. Yamashita, "Equivalent circuit representation and explanation of attenuation poles of a dual-mode dielectric resonator bandpass filter," IEEE Trans. Microwave Theory & Tech., vol. 46, pp. 2159-2163, Dec. 1998.

A.D. Lapidus and C. Rossiter, "Cross-coupling in microwave bandpass filters," Microwave Journal, pp. 22-46, Nov. 2004.

Tze-min Shen; Chi-Feng Chen' Huang, Ting-Yi; Wu, Ruey-Beei, "Design of Vertically Stacked Waveguide Filters in LTCC," Microwave Theory and Techniques, IEEE Transactions on, vol. 55, No. 8, pp. 1771,1779, Aug. 2007.

Hung-Yi Chien; Tze-Min Shen; Huang; Ting-Yi; Wei-Hsin Wang; Wu, Ruey-Beei, "Miniaturized Bandpass Filters with Double-Folded Substrate Integrated Resonators in LTCC," Microwave Theory and Techniques, IEEE Transactions on vol. 57, No. 7, pp. 1774, 1782, Jul. 2009.

Bo-Jiun Chen; Tze-Min Shen; Wu, Ruey-Beei, "Dual Band Vertically Stacked Laminated Waveguide Filter Design in LTCC Technology," Microwave Theory and Techniques, IEEE Transactions on, vol. 57, No. 6, pp. 1554, 1562, Jun. 2009.

Wolfram Wersing, Microwave ceramics for resonators and filters, Current Opinion in Solid State and Materials Science, vol. 1, Issue 5, Oct. 1996, pp. 715-731, ISSN 1359-0286.

Shen T et al, Full-Wave Design of Canonical Waveguide Filters by Optimation, 2001 IEEE MTT-S International Microwave Symposium Digest (IMS 2001) Phoenix, AZ, May 20-25, 2001, pp. 1487-1490.

John David Rhodes, The Generalized Direct-Coupled Cavity Linear Phase Filter, IEEE Transactions on Microwave Theory and Techniques, vol. MTT-18, No. 6, Jun. 1, 1970, pp. 308-313, XP001401320, abstract.

Y. Cassivi et al, Low-Cost and High-Q Millimeter-Wave Resonator Using Substrate Integrated Waveguide Technique, Microwave Conference, 2002. 32nd European, pp. 1-4.

DIELECTRIC WAVEGUIDE FILTER WITH DIRECT COUPLING AND ALTERNATIVE CROSS-COUPLING

CROSS REFERENCE TO RELATED AND CO-PENDING APPLICATIONS

This patent application is a continuation patent application which claims the benefit of the filing date of U.S. patent application Ser. No. 14/490,284 filed on Sep. 18, 2014 now U.S. Pat. No. 9,130,258 issued on Sep. 8, 2015, entitled "Dielectric Waveguide Filter with Direct Coupling and Alternative Cross-Coupling", the disclosure of which is explicitly incorporated herein by reference as are all references cited therein, which is a continuation-in-part application of, and claims the benefit of the filing date and disclosure of, U.S. patent application Ser. No. 14/088,471 filed on Nov. 25, 2013 now U.S. Pat. No. 9,130,255 issued on Sep. 8, 2015 and titled "Dielectric Waveguide Filter with Direct Coupling and Alternative Cross-Coupling" and also claims the benefit of the filing date and disclosure of U.S. Provisional Patent Application Ser. No. 61/881,138 filed on Sep. 23, 2013 and titled "Dielectric Waveguide Filter with Direct Coupling and Alternative Cross-Coupling", the contents of which are entirely incorporated herein by reference as well as all references cited therein.

FIELD OF THE INVENTION

The invention relates generally to dielectric waveguide filters and, more specifically, to a dielectric waveguide filter with direct coupling and alternative cress-coupling.

BACKGROUND OF THE INVENTION

This invention is related to a dielectric waveguide filter of the type disclosed in U.S. Pat. No. 5,926,079 to Heine et al. in which a plurality of resonators are spaced longitudinally along the length of a monoblock and in which a plurality of slots/notches are spaced longitudinally along the length of the monoblock and define a plurality of bridges between the plurality of resonators which provide a direct inductive/capacitive coupling between the plurality of resonators.

The attenuation characteristics of a waveguide filter of the type disclosed in U.S. Pat. No. 5,926,079 to Heine et al. can be increased through the incorporation of zeros in the form of additional resonators located at one or both ends of the waveguide, filter. A disadvantage associated with the incorporation of additional resonators, however, is that it also increases the length of the filter which, in some applications, may not be desirable or possible due to, for example, space limitations on a customer's motherboard.

The attenuation characteristics of a filter can also be increased by both direct and cross-coupling the resonators as disclosed in, for example, U.S. Pat. No. 7,714,680 to Vangala et al. which discloses a monoblock filter with both inductive direct coupling and quadruplet crosscoupling of resonators created in part by respective metallization patterns which are defined on the top surface of the filter and extend between selected ones of the resonator through-holes to provide the disclosed direct and cross-coupling of the resonators.

Direct and cross-coupling of the type disclosed in U.S. Pat. No. 7,714,680 to Vangala et al. and comprised of top surface metallization patterns is not applicable in waveguide filters of the type disclosed in U.S. Pat. No. 5,926,079 to Heine et al. which includes only slots and no top surface metallization patterns.

The present invention is thus directed to a dielectric waveguide filter with both direct and optional cross-coupled resonators which allow for an increase in the attenuation characteristics of the waveguide filter without an increase in the length of the waveguide filter or the use of metallization patterns on the top surface of the filter.

SUMMARY OF THE INVENTION

The present invention is directed to a waveguide filter adapted for the transmission of an RF signal and comprising a base block of dielectric material covered with a layer of conductive material and defining at least first and second resonators, a bridge block of dielectric material covered with a layer of conductive material and defining a third resonator, the base block and the bridge block being coupled to each other in a relationship wherein the bridge block bridges the first and second resonators, a first RF signal transmission window defined between the base block and the bridge block and defining a first path for the transmission of the RF signal between the first and third resonators, and a second RF signal transmission window defined between the base block and the bridge block and defining a second path for the transmission of the RF signal between the third resonator and the second resonator.

In one embodiment, the base block defines a longitudinal axis and the first and second RF signal transmission windows are positioned on opposite sides of the longitudinal axis in a relationship spaced and parallel to each other and the longitudinal axis.

In one embodiment, the base block defines a longitudinal axis and the first and second RF signal transmission windows are positioned in a relationship spaced and parallel to each other and normal to the longitudinal axis.

In one embodiment, the base block defines a longitudinal axis and further comprising a third RF signal transmission window defined between the base block and the bridge block and defining a third path for the transmission of the RF signal between the first resonator and the third resonator, the first and third RF signal transmission windows being positioned on opposite sides of the longitudinal axis in a relationship parallel to each other and the longitudinal axis and in a relationship normal to the second RF signal transmission window.

In one embodiment, the base block is comprised of first and second base blocks each covered with a layer of conductive material and joined together in an end to end co-linear relationship and the bridge block bridges the joined ends of the first and second base blocks, the first and second resonators being defined on the first and second base blocks respectively.

The present invention is also directed to a waveguide filter adapted for the transmission of an RF signal and comprising a first block of dielectric material covered with a layer of conductive material and defining at least a first resonator, a second block of dielectric material covered with a layer of conductive material and defining at least a second resonator, a third block of dielectric material covered with a layer of conductive material and defining at least a third resonator, the third block of dielectric material being coupled to and bridging the first and second blocks of dielectric material, a first RF signal transmission window defined between the first block and the third block and defining a first path for the transmission of the RF signal between the first resonator and the third resonator, and a second RF signal transmission window defined between the second block and the third block and defining a second path for the transmission of the RF signal between the third resonator and the second resonator.

In one embodiment, the first and second blocks are joined together in an end to end co-linear relationship and the third block bridges the coupled ends of the first and second base blocks.

In one embodiment, the waveguide filter further comprises an RF signal input/output electrode at one end of each of the first and second blocks, a step defined at the one end of each of the first and second blocks, the RF signal input/output electrode extending through the step, and a slit defined in each of the first and second blocks, the slit in the first block defining the first resonator and a fourth resonator in the first block, and the slit in the second block defining the second resonator and a fifth resonator in the second block, the RF signal input/output electrode and the step being defined in the fourth and fifth resonators respectively, and the third block is located between and spaced from the slits defined in the first and second blocks.

The present invention is further directed to a waveguide filter adapted for transmission of an RF signal and comprising a base block of dielectric material covered with a layer of conductive material and defining at least first and second resonators, a bridge block of dielectric material covered with a layer of conductive material and defining at least a third resonator, the bridge block being stacked on top of the base block in a relationship wherein the bridge block bridges the first and second resonators of the base block, a first interior direct coupling RF signal transmission window defined between the base block and the bridge block and defining a first direct path for the transmission of the RF signal between the first and third resonators, a second interior direct RF signal transmission window defined between the base block and the bridge block and defining a second direct path for the transmission of the RF signal between the second and third resonators, and a first cross-coupling RF signal transmission means defining a first cross-coupling path for the transmission of the RF signal between the first and second resonators.

In one embodiment, the base block is comprised of first and second base blocks each covered with a layer of conductive material and joined together in an end to end and co-linear relationship, the first and second resonators being defined on the first and second base blocks respectively, the first cross-coupling RF signal transmission means comprising a capacitive cross-coupling external transmission line extending between the first and second resonators, the first and second interior direct coupling transmission windows defining first and second capacitive direct coupling RF signal transmission paths.

In one embodiment, the base block is comprised of first and second base blocks each covered with a layer of conductive material and joined together in an end to end and co linear relationship, the first and second resonators being defined on the first and second base blocks respectively, the first cross-coupling RF signal transmission means comprising a third RF signal transmission window defined between the first and second base blocks and defining a first inductive cross-coupling RF signal transmission path between the first and second resonators, the first and second interior direct coupling transmission windows defining first and second capacitive direct coupling RF signal transmission paths.

In one embodiment, the first cross-coupling RF signal transmission means comprises an RF signal transmission bridge defined in the base block between the first and second resonators and defining a first inductive cross-coupling RF signal transmission path between the first and second resonators, the first and second interior direct coupling transmission windows defining first and second inductive direct coupling RF signal transmission paths.

In one embodiment, the waveguide filter further comprises a third interior direct coupling transmission window defined between the base block and the bridge block and defining a third direct path for the transmission of the RF signal between the first resonator and the third resonator, the first and third interior direct coupling transmission windows defining first and third capacitive direct coupling RF signal transmission paths between the first and second resonators.

Other advantages and features of the present invention will be more readily apparent from the following detailed description of the preferred embodiments of the invention, the accompanying drawings, and the appended claims.

BRIEF DESCRIPTION OF THE DRAWINGS

These and other features of the invention can best be understood by the following description of the accompanying FIGURES as follows.

DETAILED DESCRIPTION OF THE EMBODIMENTS

Figure 1:
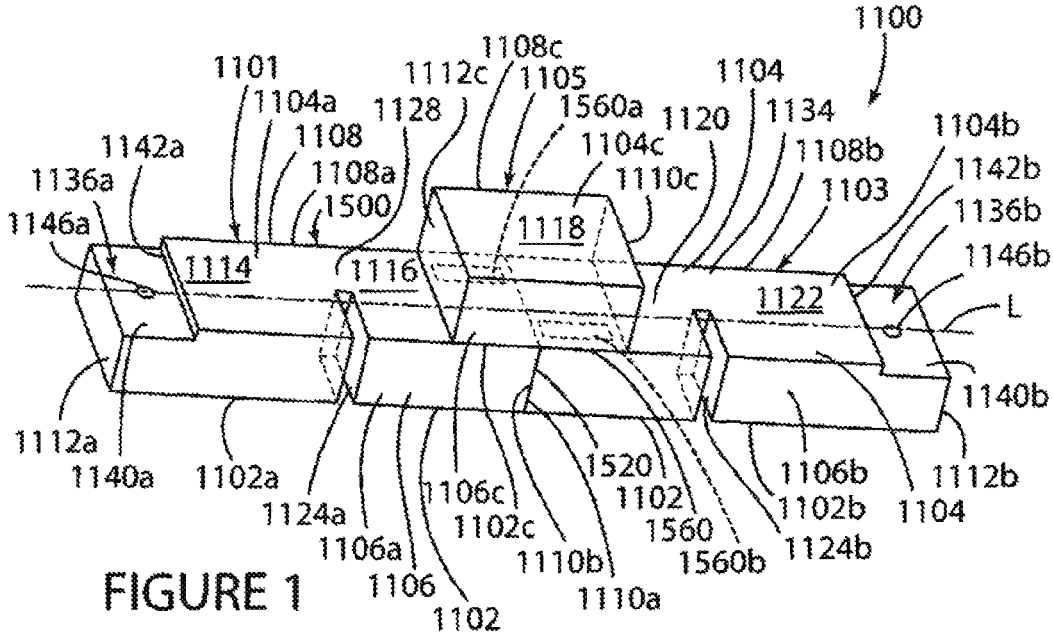
FIG. 1 is an enlarged top perspective view of a dielectric waveguide filter according to the present invention.
Figure 2:
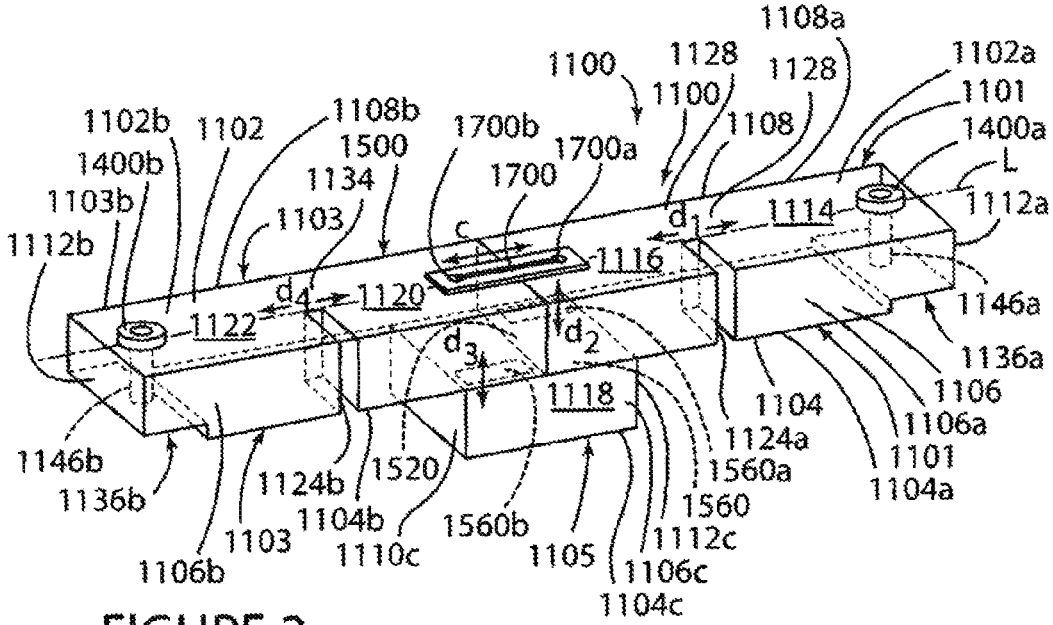
FIG. 2 is an enlarged bottom perspective view of the dielectric filter shown in FIG. 1.

FIGS. 1 and 2 depict a five pole embodiment of a waveguide filter 1100 incorporating both direct and alternate cross-coupling/indirect coupling elements in accordance with the present invention.

In the embodiment shown, the waveguide filter 1100 is made from three separate monoblocks or blocks 1101, 1103, and 1105 (i.e., two base blocks 1101 and 1103 and a bridge block 1105) of dielectric material that have been coupled and stacked together in a relationship with the base blocks 1101 and 1103 positioned in an end to end relationship and the block 1105 seated over and bridging and interconnecting the ends and end resonators of the base blocks 1101 and 1103 as described in more detail below.

The monoblock 1101 which, in the embodiment shown is generally parallelepiped shaped, is comprised of a solid elongate block of suitable dielectric material, such as for example ceramic, and includes opposed longitudinal horizontal surfaces or exterior faces 1102*a* and 1104*a*, opposed longitudinal side vertical surfaces or exterior faces 1106*a* and 1108*a*, and opposed transverse side vertical end surfaces or exterior end faces or ends 1110*a* and 1112*a*.

The monoblock 1103 which, in the embodiment shown is also generally parallelepiped-shaped, is also comprised of a solid elongate block of suitable dielectric material, such as for example ceramic, and includes opposed longitudinal horizontal surfaces or exterior faces 1102*b* and 1104*b*, opposed longitudinal side vertical surfaces or exterior faces 1106*b* and 1108*b*, and opposed transverse side vertical surfaces or exterior end faces or ends 1110*b* and 1112*b*.

In the embodiment shown, each of the monoblocks 1101 and 1103 are of the same length, width, and height and each include a pair of resonant sections (also referred to as cavities or cells or resonators or poles) 1114 and 1116 and 1120 and 1122 respectively which are spaced longitudinally and horizontally co-planarly along the length of the respective monoblocks 1101 and 1103. The resonators 1114 and 1116 in the monoblock 1101 are separated from each other by a vertical slit or slot 1124*a* that is cut into the vertical exterior surface 1106*a* and, more specifically, is cut into the surfaces 1102*a*, 1104*a*, and 1106*a* of the monoblock 1101. The resonators 1120 and 1122 in the monoblock 1103 are separated from each other by a vertical slit or slot 1124*b* in the monoblock 1103 that is cut into the vertical exterior surface 1106*b* and, more specifically, is cut into the surfaces 1102*b*, 1104*b*, and 1106*b* of the monoblock 1103.

The slit 1124*a* in the monoblock 1101 defines a through-way or pass or bridge 1128 of dielectric material on the monoblock 1101 for the direct coupling and transmission of an RF signal between the resonator 1114 and the resonator 1116. Similarly, the slit 1124*b* in the monoblock 1103 defines a through-way or pass or bridge 1134 of dielectric material on the monoblock 1103 for the direct coupling and transmission of an RF signal between the resonator 1120 and the resonator 1122.

The monoblock 1101 additionally comprises and defines an end step 1136*a* comprising, in the embodiment shown, a generally L-shaped recessed or grooved or shouldered or notched region or section of the longitudinal surface 1104*a*, opposed side surfaces 1108*a* and 1108*a*, and end surface or face 1112*a* of the monoblock 110.

The monoblock 1103 similarly additionally comprises and defines an end step 1136*b* comprising, in the embodiment shown, a generally L-shaped recessed or grooved or shouldered or notched region or section of the longitudinal surface 1104*b*, opposed side surfaces 1106*b* and 1108*b*, and end surface or face 1112*b* of the monoblock 1103.

Thus, in the embodiment shown, the respective steps 1136*a* and 1136*b* are defined in and by respective end sections or regions 1112*a* and 1112*b* of the respective monoblocks 1101 and 1103 having a height less than the height of the remainder of the respective monoblocks 1101 and 1103.

In the embodiment shown, the respective steps 1136*a* and 1136*b* each comprise a generally L-shaped recessed or notched portion of the respective end resonators 1114 and 1122 defined on the respective monoblocks 1101 and 1103 which include respective first generally horizontal surfaces 1140*a* and 1140*b* located or directed inwardly of, spaced from, and parallel to the surfaces 1104*a* and 1104*b* of the respective monoblocks 1101 and 1103 and respective second generally vertical surfaces or walls 1142*a* and 1142*b* located or directed inwardly of, spaced from, and parallel to, the respective end faces 1112*a* and 1112*b* of the respective monoblocks 1101 and 1103.

Further, and although not shown or described herein in any detail, it is understood that the end steps 1136*a* and 1136*b* could also be defined by an outwardly extending end section or region the respective monoblocks 1101 and 1103 having a height greater than the height of the remainder of the respective monoblocks 1101 and 1103.

The monoblocks 1101 and 1103 additionally each comprise an electrical RF signal input/output electrode in the form of respective through-holes 1146*a* and 1146*b* which extend through the body of the respective monoblocks 1101 and 1103 and, more specifically, extend through the respective steps 1136*a* and 1136*b* thereof and, still more specifically, through the body of the respective end resonators 1114 and 1122 defined in the respective monoblocks 1101 and 1103 between, and in relationship generally normal to, the respective surfaces 1140*a* and 1140*b* of the respective steps 1136*a* and 1136*b* and the respective surfaces 1102*a* and 1102*b* of the respective monoblocks 1101 and 1103.

Still more specifically, respective input/output through-holes 1146*a* and 1146*b* are spaced from and generally parallel to the respective transverse end faces 1112*a* and 1112*b* of the respective monoblocks 1101 and 1103 and define respective generally circular openings located and terminating in the respective step surfaces 1140*a* and 1140*b* and the respective monoblock surfaces 1102*a* and 1102*b* respectively.

The respective RF signal input/output through-holes 1146*a* and 1146*b* are also located and positioned in and extend through the interior of the respective monoblocks 1101 and 1103 in a relationship generally spaced from and parallel to the respective step wall or surfaces 1142*a* and 1142*b*.

Thus, in the embodiment shown, the through-hole 1146*a* is positioned between the end face 1112*a* and the step surface 1142*a* of the block 1101 and the through hole 1146*b* is positioned between the end face 1112*b* and the step surface 1142*b* of the block 1103. Still further, in the embodiment shown, the steps 1136*a* and 1130*b* terminate at a point spaced from and short of the respective slits 1124*a* and 1124*b* of the respective blocks 1101 and 1103.

All of the external surfaces 1102*a*, 1104*a*, 1106*a*, 1108*a*, 1110*a*, and 1112*a* of the monoblock 1101, the internal surfaces of the monoblock 1101 defining the slit 1124*a*, and the internal surface of the monoblock 1101 defining the RF signal input/output through-hole 1146*a* are covered with a suitable conductive material, such as for example silver, with the exception of the regions described in more detail below.

Similarly, all of the exterior surfaces 1102*b*, 1104*b*, 11006*b*, 1110*b*, and 1112*b* of the monoblock 1103, the internal surfaces of the monoblock 1103 defining the slit 1124*b*, and the internal surface of the monoblock 1103 defining the RF signal input/output through-hole 1146*b* are covered with a suitable conductive material, such as for example silver, with the exception of the regions described in more detail below.

The monoblocks 1101 and 1103 still further comprise respective RF signal input/output connectors 1400*a* and 1400*b* protruding outwardly from the respective openings defined in the respective surfaces 1102*a* and 1102*b* the respective through-holes 1146*a* and 1146*b*.

The monoblock or bridge block 1105 which, in the embodiment shown is also generally rectangular in shape, is of the same width and height as the base blocks 1101 and

1103 but has a length that is less than one half the length of each of the blocks 1101 and 1103, is comprised of a suitable solid block of dielectric material, such as for example ceramic, and includes opposed longitudinal horizontal surfaces or exterior faces 1102*c* and 1104*c*, opposed longitudinal side vertical surfaces or exterior faces 1106*c* and 1108*c*, and opposed transverse side vertical end surfaces or exterior end faces 1110*c* and 1112*c*.

The monoblock 1105 defines a resonant section 1118 (also referred to as a cavity or cell or resonator or pole).

The separate monoblocks 1101 and 1103 are positioned relative to each in an end to end horizontally co-linear and co-planar relationship with the respective end faces or ends 1110*a* and 1110*b* thereof located opposite each other and, in the embodiment shown, in a relationship with the respective end faces or ends 1110*a* and 1110*b* abutted and coupled/joined to each other; the respective horizontal longitudinal bottom exterior surfaces 1102*a* and 1102*b* of the monoblocks 1101 and 1103 are disposed in a horizontal co-planar relationship; the respective horizontal longitudinal top exterior surfaces 1104*a* and 1104*b* of the respective monoblocks 1101 and 1103 are disposed in a horizontal coplanar relationship; the respective vertical longitudinal side exterior surfaces 1106*a* and 1106*b* of the respective monoblocks 1101 and 1103 are disposed in a vertical co-planar relationship; and the respective vertical longitudinal side exterior surfaces 1108*a* and 1108*b* of the respective monoblocks 1101 and 1103 are disposed in a vertical co-planar relationship.

The monoblock 1105 is positioned relative to the blocks 1101 and 1103 in a bridging or overlapping or offset or raised or stacked relationship relative to the base blocks 1101 and 1105 wherein opposed ends of the block 1105 bridge or straddle the ends or faces 1110*a* and 1110*b* of the respective blocks 1101 and 1103 and, more specifically, in the embodiment shown, in a relationship wherein the ends of the block 1105 straddle the joined ends of the blocks 1101 and 1103 with one end of the block 1105 overlapping and seated on a portion of the end resonator 1120 of the block 1103 and an opposite end of the block 1105 overlapping and seated on a portion of the end resonator 1116 of the block 1101. Thus, in the embodiment shown, the bottom exterior surface 1102*c* of block 1105 is seated against the respective joined end portions of the respective top surfaces 1104*a* and 1104*b* of the respective monoblocks 1101 and 1103.

Thus, in the embodiment shown, the blocks 1101 and 1103 comprise base blocks which when coupled together define an elongate parallelepiped shaped base block 1500 of dielectric material defining a longitudinal axis L and including opposed, spaced-apart, and parallel horizontal to and bottom exterior faces 1102 (defined by the exterior faces 1102*a* and 1102*b* of the respective blocks 1101 and 1103) and 1104 (defined by the exterior faces 1104*a* and 1104*b* of the respective monoblocks 1101 and 1103) and extending in the direction of the longitudinal axis L; opposed, spaced-apart, and parallel vertical side exterior surfaces 1106 (defined by the exterior faces 1106*a* and 1106*b* of the respective blocks 1101 and 1103) and 1108 (defined by the exterior faces 1108*a* and 1108*b*) and extending in the direction of the longitudinal axis L; opposed transverse vertical side end faces 1112*a* and 1112*b* (defined by the exterior end faces 1112*a* and 1112*b* of the respective blocks 1101 and 1103) extending in a direction normal to and intersecting the longitudinal axis L; opposed end steps 1136*a* and 1136*b* (defined by the end steps 1136*a* and 1136*b* of the respective blocks 1101 and 1103); slits or slots 1124*a* and 1124*b* (defined by the slits or slots 1124*a* and 1124*b* of the respective blocks 1101 and 1103) and extending along the length of the base block 1500 in a spaced-apart and parallel relationship relative to each and in a direction and orientation normal to the longitudinal axis L with the slit 1124*a* located adjacent and spaced from the end face 1112*a* and the slit 1124*b* located adjacent and spaced from the opposed end face 1112*b*; and a centrally located interior layer of conductive material 1520 (defined by the layer of conductive material covering the respective exterior faces 1110*a* and 1110*b* of the respective blocks 1101 and 1103) and extending in a direction normal to the longitudinal axis L of the base block 1500.

The combination of the dielectric material of the base block 1500, the silts or slots 1124*a* and 1124*b*, and the central interior layer of conductive material 1520 define the plurality of resonators 1114, 1116, 1120 and 1122 in the base block 1500 that extend generally co-linearly in the direction of the longitudinal axis L and in which the resonators 1114 and 1116 are coupled by the bridge of dielectric material 1128 therebetween and the resonators 1120 and 1122 are coupled by the bridge of dielectric material 1134 therebetween. The bridges 1128 and 1134 extend in a direction normal to the longitudinal axis L. The interior layer of conductive material 1520 separates the resonators 1114 and 1116 of the base block 1101 from the resonators 1120 and 1122 of the base block 1103 and is located between and in a relationship parallel to the respective resonators 1114, 1116, 1120, 1122 and the respective slits or slots 1124*a* and 1124*b*.

In the embodiment shown, the bridge or bridging block 1105 is centrally located on the base block 1500 in a relationship wherein the bridge block 1105 bridges and interconnects the resonator 1116 of the base block 1103 to the resonator of the base block 1101. Specifically, in the embodiment shown, the bridge block 1105 is located centrally over the portion of the base block 1500 including the interior layer of conductive material 1520 in a bridging or overlapping relationship wherein a first half portion of the block 1105 is located on one side of the interior layer of conductive material 1520 and is seated against the exterior surface 1104*a* of the base block 1101 and the other half portion of the base block 1105 is located on the other side of the interior layer of conductive material 1520 and is seated against the exterior surface 1104*b* of the base block 1103.

Further, in the embodiment shown, the vertical exterior side surface 1106*c* of the bridge block 1105 is vertically co-planar with the vertical exterior side surface 1106 of the base block 1500 (i.e., vertically co-planar with the vertical exterior side surfaces 1106*a* and 1106*b* of the respective base blocks 1101 and 1103) and the opposed vertical exterior side surface 1108*c* of the platform block 1105 is vertically co-planar with the vertical exterior side surface 1108 of the base block 1500 (i.e., vertically co-planar with the vertical exterior side surfaces 1108*a* and 1108*b* of the respective base blocks 1101 and 1103.

Still further, in the embodiment shown, the bridge block 1105 is centrally located and seated against the top surface 1104 of the base block 1500 between and spaced from the respective slits 1124*a* and 1124*b* that are defined in the base block 1500.

Still further, in the embodiment shown, the external transmission line 1700 is seated on the bottom surface 1102 of the base block 1500 (i.e., is seated on and extends between the respective bottom surfaces 1102*a* and 1102*b* of the respective joined base blocks 1101 and 1103) in a relationship and position opposed to the bridge block 1105 on the top surface 1104.

In the embodiment shown, the waveguide filter 1100 includes another interior layer of conductive material 1560 located between the base block 1500 and the bridge block 1105 and, more specifically, an interior layer of conductive material 1560 that separates the dielectric material comprising the base block 1500 from the dielectric material comprising the bridge block 1105 and, still more specifically, an interior layer of conductive material 1560 that separates the respective resonators 1116 and 1120 of the respective base blocks 1101 and 1103 from the resonator 1118 of the bridge block 1105.

Thus, in the embodiment shown, and by virtue of the offset, raised, and overlapping position and relationship of the bridge block 1105 relative to the base blocks 1101 and 1103, the bridge block 1105 and the resonator 1118 and pole defined by the bridge block 1105 are positioned in a horizontal plane offset and parallel to the horizontal plane in which the base blocks 1101 and 1103 and the resonators 1114, 1116, 1118, and 1120 and the poles thereof.

The elements for providing direct capacitive coupling and indirect capacitive cross-coupling between the resonators 1114, 1116, 1118, 1120, and 1122 of the waveguide filter 1100 will now be described.

Initially, waveguide filter 1100 comprises a first means for providing a direct capacitive RF signal coupling or transmission between the resonator 1116 of the base block 1101 and the resonator 1118 of the bridge block 1105 and a second means for providing a direct capacitive RF signal coupling or transmission between the resonator 1118 of the bridge block 1103 and the resonator 1120 of the base block 1103 comprising respective interior windows 1560*a* and 1560*b* in the interior of the waveguide filter 1100 and, more specifically respective regions 1560*a* and 1560*b* in the interior layer of conductive material 1560 located between the base block 1500 (the joined monoblocks 1101 and 1103) and the bridge block 1105 which are devoid of conductive material, i.e., regions of dielectric material in which the dielectric material of the base block 1500 (the dielectric material of the joined monoblocks 1101 and 1103) is in contact with the dielectric material of the bridge block 1105. The windows 1560*a* and 1560*b* are located on opposite sides of the interior layer of conductive material 1520.

In the embodiment shown, the internal or interior windows 1560*a* and 1560*b* are located in the interior of the waveguide filter 1100 at opposite diagonal corners of the bridge block 1105 to maximize the length of the path of the RF signal through the resonator 1118 defined by the bridge block 1105. In the embodiment shown, the interior windows 1560*a* and 1560*b* are both generally rectangular in shape and of the same size and area; extend in the same direction relative to each other; and extend in the same direction as, parallel to, and spaced from, the longitudinal axis L.

Moreover, it is understood that the respective interior windows 1560*a* and 1560*b* are defined by respective regions in the exterior layer of conductive material that covers the respective exterior surfaces 1104*a*, 1104*b*, and 1102*c* of the respective blocks 1101, 1103 and 1105 that are devoid of conductive material and which are respectively aligned with each when the blocks 1101, 1103, and 1105 are coupled together to define the respective interior windows 1560*a* and 1560*b*.

The waveguide filter 1100 additionally comprises a means for providing an indirect alternate capacitive cross-coupling or transmission of the RF signal between the resonator 1116 of the base block 1101 and the resonator 1120 of the base block 1103 in the form of an external RF signal transmission strip line 1700 that includes one end 1700*a* seated against the portion of the exterior surface 1102 of the base block 1500 located on one side of the interior layer of conductive material 1520 (i.e., against the exterior surface 1102*a* of the monoblock 1101) and an opposite end 1700*b* seated against the portion of the exterior surface 1102 of the base block 1600 located on the other side of the interior layer of conductive material 1520 (i.e., against the exterior surface 1102*b* of the monoblock 1103). Although not show, it is understood that each end of the transmission line 1700 includes a capacitive pad located below each respective end of the transmission line 1700 and a metallized via.

In accordance with the invention, an RF signal is transmitted through the waveguide filter 1100 as now described in more detail. Initially, and where the connector 1400*a* is the RF signal input connector, the RF signal is transmitted initially into the step 1136*a* and directly through the resonator 1114 of the base block 1500 (the step 1136*a* and resonator 1114 of the base block 1101); then directly into the resonator 1116 in the base block 1500 (the resonator 1116 in the monoblock 1101) via the direct coupling path $d_1$ through the direct coupling RF signal bridge of dielectric material 1128 defined in the base block 1600 (base block 1101) between the resonators 1114 and 1116; then from the resonator 1116 into the resonator 1120 in the base block 1500 (from the resonator 1116 in the base block 1101 into the resonator 1120 in the base block 1103) via both the capacitive cross-coupling path, generally designated by the arrow c in FIG. 2, and defined by the external transmission line 1700, and the direct capacitive coupling path, generally designated by the arrows $d_2$ and $d_3$ in FIG. 2, and defined by the windows 1560*a* and 1560*b* and the bridge block 1105; then from the resonator 1120 into the resonator 1122 and the step 1136*b* in the base block 1500 (the resonator 1122 and the step 1136*b* in the base block 1101) via the direct coupling path $d_4$ path provided by the bridge of dielectric material defined between the two resonators 1120 and 1122; and then out through the output connector 1400*b*.

Thus, in the embodiment shown, the RF signal transmission and coupling paths $d_2$ and $d_3$ are oriented and extend in a direction generally normal to the coupling paths $d_1$, c, and $d_4$.

Figure 9:
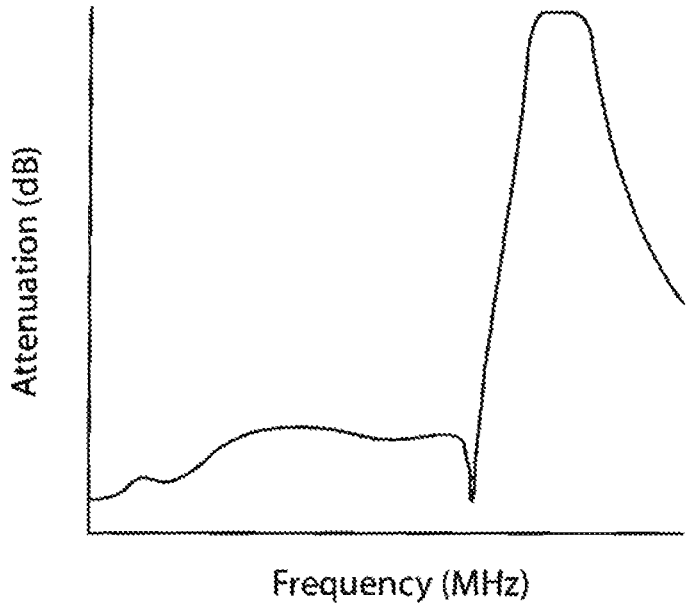
FIG. 9 is a graph depicting the performance of the dielectric waveguide filter shown in FIGS. 1 and 5.

The performance of the waveguide filter 100 is shown in FIG. 9 which shows the notch that is created below the passband as a result of the interaction between the direct coupling and indirect capacitive cross-coupling elements of the waveguide filter 1100. In the embodiment shower, the RF signal being transmitted directly through the resonators 1114, 1116, 1118, 1120, and 1122 of the waveguide filter 1100 (i.e., through the resonators 1114 and 1116 of the base block 1101, the resonator 1118 of the bridge block 1105, and the resonators 1120 and 1122 of the base block 1103) and the alternate RF sign transmitted between the resonators 1116 and 1120 of the waveguide filter 1100 (i.e., the resonators 1120 and 1122 of the base block 110) cancel each other at a predetermined frequency located below the passband to create the notch that improves filter rejection.

Figure 3:
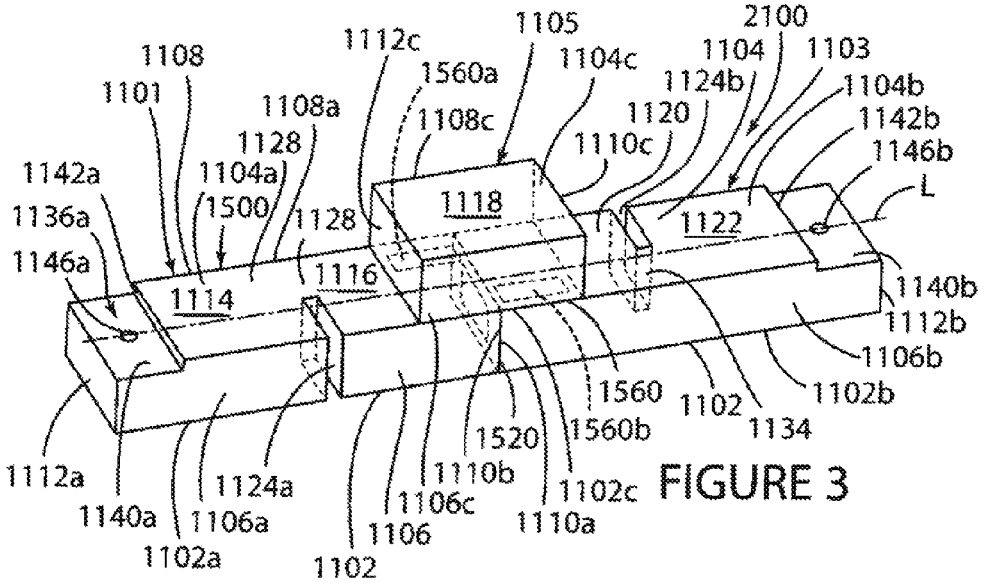
FIG. 3 is an enlarged top perspective view of another embodiment of a dielectric waveguide filter according to the present invention.
Figure 4:
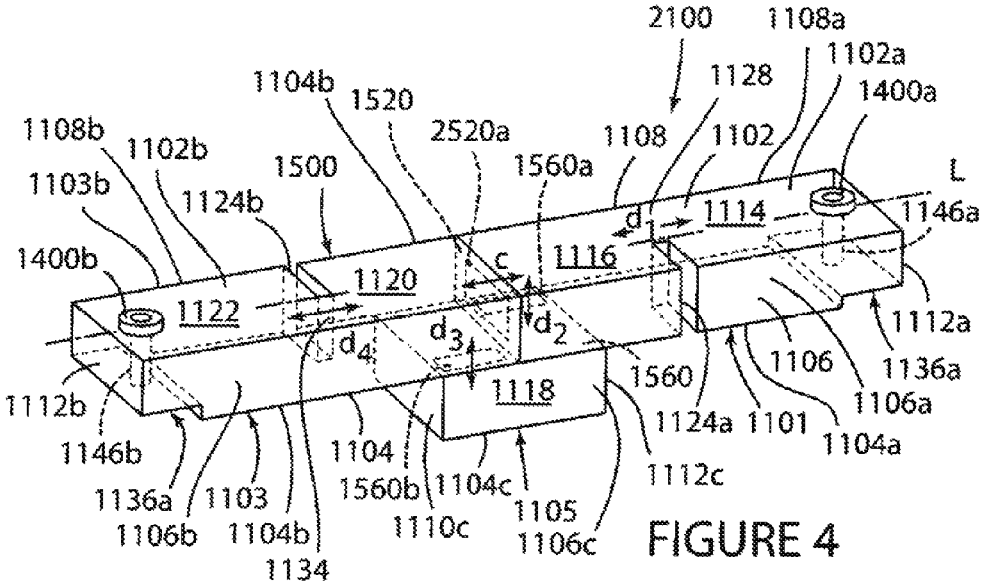
FIG. 4 is an enlarged bottom perspective view of the dielectric waveguide filter shown in FIG. 3.

FIGS. 3 and 4 depict another embodiment of a waveguide filter 2100 in accordance with the present invention in which the majority of the elements thereof are identical in structure and function to the elements in the waveguide filter 1100 except as otherwise described below. As a result, the elements of the waveguide filters 1100 and 2100 which are identical in structure and function have been identified with the same numerals in FIGS. 1, 2, 3 and 4 and thus the earlier description of the structure and function of such elements with respect to the waveguide filter 1100 shown in FIGS. 1 and 2 is incorporated herein by reference with respect to the waveguide filter 2100 shown in FIGS. 3 and 4 except as otherwise discussed below in more detail.

Specifically, the waveguide filter 2100 differs from the waveguide filter 1100 in that the slits 1124*a* and 1124*b* defined in the base block 1500 (i.e., the slit 1124*a* defined in the base block 1101 and the slit 1124*b* defined in the base block 1103) are located on the opposite sides 1106 and 1108 of the base block 1500 (i.e., on opposite sides 1106*a* and 1108*a* of the respective base blocks 1101 and 1103) rather than on the same side 1106 as with the slits 1124*a* and 1124*b* of the waveguide 1100.

Additionally, in the waveguide filter 2100, there is not external transmission line 1700. Instead, an interior inductive alternate cross-coupling RF signal transmission line or path, generally designated by the arrow c in FIG. 4, is defined by an internal window or region 1520*a* in the interior layer of conductive material 1520 of the base block 1500 (the layer of conductive material 1520 between the base blocks 1101 and 1103 that separates the respective resonators 1116 and 1120 thereof) that is devoid of conductive material, i.e., a window or region of dielectric material where the dielectric material of the monoblock 1101 is in contact with the dielectric material of the monoblock 1103.

Stated another way, it is understood that the interior window 1520*a* is defined by respective regions in the exterior layer of conductive material that covers the respective exterior surfaces 1110*a* and 1110*b* of the respective blocks 1101 and 1103 that are devoid of conductive material and which are respectively aligned with each when the blocks 1101 and 1103 are coupled together end to end as described above.

Thus, the path of transmission of the RF signal through the waveguide filter 2100 is identical to the path of transmission of the RF signal through the waveguide filter 1100 and thus the earlier description thereof is incorporated herein by reference except that the transmission of the RF signal between the resonator 1116 of the base block 1101 and the resonator 1120 of the base block 1103 occurs not only via the direct capacitive coupling means described earlier with respect to the waveguide filter 1100 (i.e., the internal windows 1560*a* and 1560*b*) but also via indirect inductive cross-coupling (via the internal window 2520*a* defined in the interior layer of conductive material 1120 that separates the base blocks 1101 and 1103) rather than the indirect capacitive cross-coupling as in the waveguide filter 1100 through the external transmission line 1700.

Figure 10:
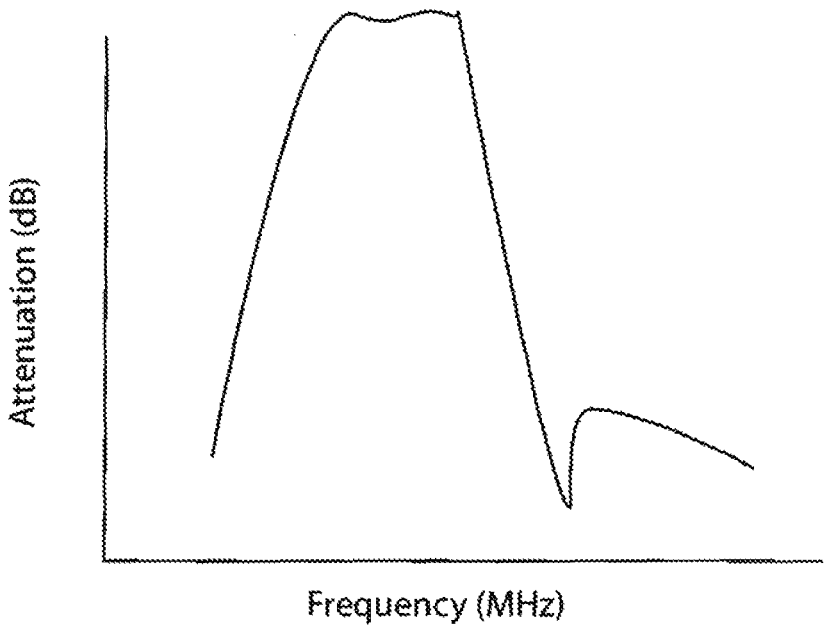
FIG. 10 is a graph depicting the performance of the dielectric waveguide filter shown in FIGS. 2 and 7.

The performance of the waveguide filter 2100 is shown in FIG. 10 which shows the notch and RF signal transmission shunt zero that is created above the passband as a result of the interaction between the direct coupling and indirect inductive cross-coupling features of the waveguide filter 2100. In the embodiment shown, the RF signal being transmitted directly through the resonators 1114, 1116, 1118, 1120, and 1122 of the waveguide filter 2100 (i.e., through the resonators 1114 and 1116 of the base block 1101, the resonator 1108 of the bridge block 1105, and the resonators 1120 and 1122 of the base block 1103) and the alternate RF signal transmitted between the resonators 1116 and 1120 of the waveguide filter 2100 (i.e., between the resonator 1116 of the base block 1101 and the resonator 1120 of the base block 1103) cancel each other at a predetermined frequency located above the passband to create the notch that improves filter rejection.

Figure 5:
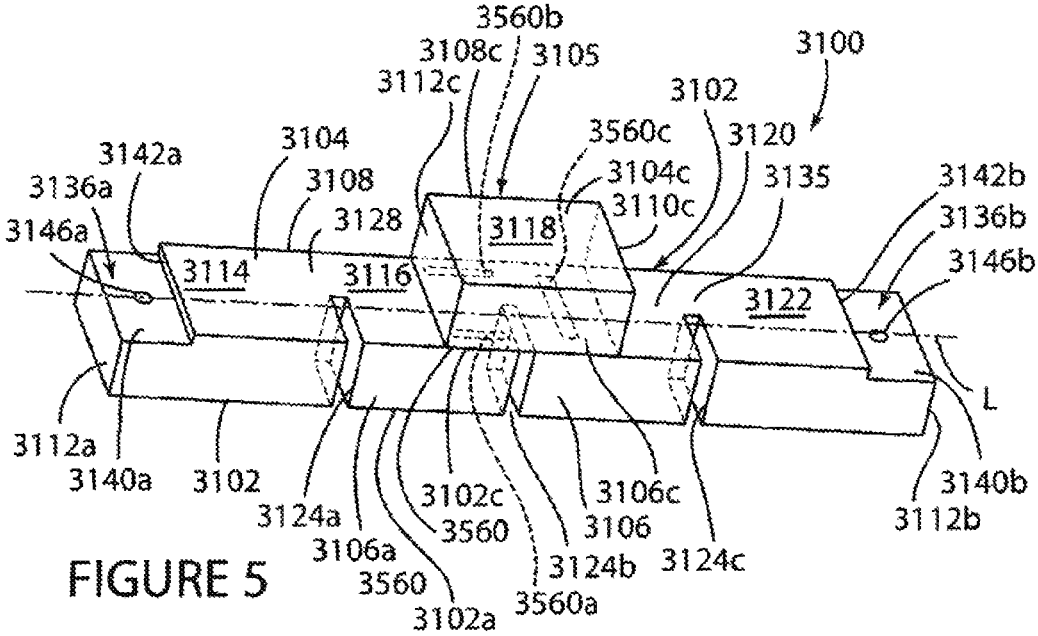
FIG. 5 is an enlarged top perspective view of a further embodiment of a dielectric waveguide filter according to the present invention.
Figure 6:
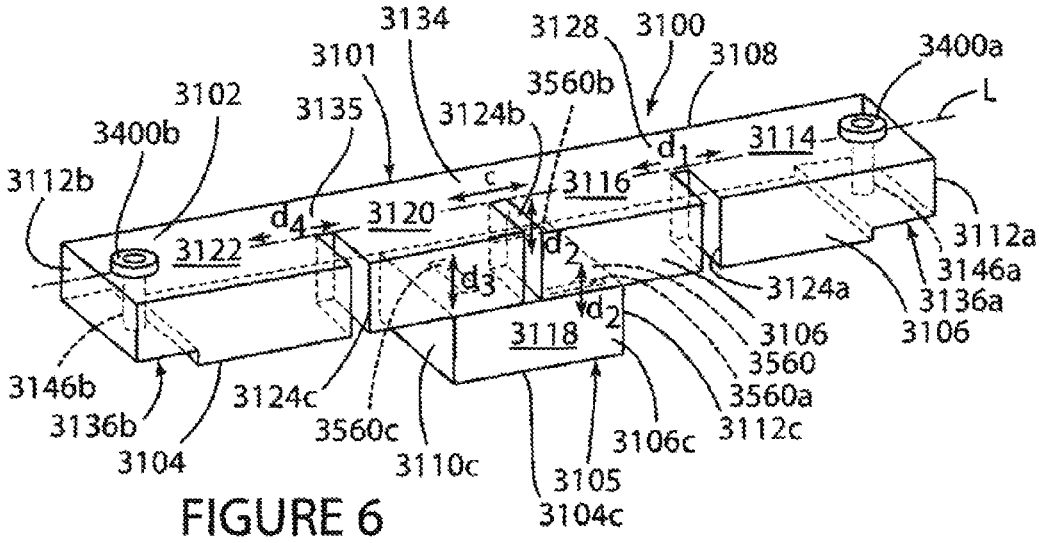
FIG. 6 is an enlarged bottom perspective view of the dielectric waveguide filter shown in FIG. 5.

FIGS. 5 and 6 show yet a further embodiment of a five waveguide filter 3100 in accordance with the present invention.

In the embodiment shown, the waveguide filter 3100 is made from two separate monoblocks or blocks 3101 and 3105 (i.e., a base block 3101 and a bridge block 3105) which have been coupled and stacked together to form the waveguide filter 3100 as described below in more detail.

The monoblock or base block 3101 which, in the embodiment shown is generally parallelepiped-shaped, is comprised of a suitable solid block of dielectric material, such as for example ceramic, and includes opposed longitudinal horizontal exterior surfaces 3102 and 3104 extending in the direction of the longitudinal axis L, opposed longitudinal side vertical exterior surfaces 3106 and 3108 extending in the direction of the longitudinal axis L, and opposed transverse side vertical exterior end surfaces or faces 3112*a* and 3112*b* extending in a direction normal to the longitudinal axis L.

The monoblock 3101 includes a plurality of resonant sections (also referred to as cavities or cells or resonators or poles) 3114, 3116, 3120, and 3122 that are spaced longitudinally along the length and longitudinal axis L of the monoblock 3101. The resonators 3114 and 3116 are separated from each other by a vertical slit or slot 3124*a* that is cut into the vertical exterior surface 3106 and, more specifically, is cut into the surfaces 3102, 3104, and 3106 of the monoblock 3101. The resonators 3116 and 3120 are separated from each other by a vertical slit or slot 3124*b* that is cut into the vertical exterior surface 3106 and, more specifically, is cut into the surfaces 3102, 3104, and 3106. The resonators 3120 and 3122 are separated from each other by a vertical slit or slot 3124*c* that is cut into the vertical exterior surface 3106 and, more specifically, is cut into the surfaces 3102, 3104 and 3106 of the monoblock 3101.

The slit 3124*a* defines a through-way or pass or bridge 3128 of dielectric material on the monoblock 3101 for the direct coupling and transmission of an RF signal between the resonator 3114 and the resonator 3116. Similarly, the slit 3124*b* defines a through-way or pass or bridge 3134 of dielectric material on the monoblock 3101 for the direct coupling and transmission of an RF signal between the resonator 3116 and the resonator 3120 and the slit 3124*c* defines a through-way or pass or bridge 3135 of dielectric material on the monoblock 3101 for the direct coupling and transmission of an RF signal between the resonator 3120 and 3122.

The slits 3124*a*, 3124*b*, and 3124*c* and the respective bridges 3128, 3134, and 3135 extend in a direction normal to the longitudinal axis L of the base block 3101. The slit 3124*a* is located adjacent and spaced from the end step 3136*a* and end face 3112*a*, the slit 3124*c* is located adjacent and spaced from the opposed end step 3136*b* and end face 3112*b*, and the slit 3124*b* is centrally located between and spaced from the slits 3124*a* and 3124*c*.

The monoblock 3131 additionally comprises and defines first and second opposed end steps 3136*a* comprising, in the embodiment shown, respective generally L-shaped recessed or grooved or shouldered or notched end regions or sections of the longitudinal surface 3102, opposed side surfaces 3106 and 3108, and respective side end surfaces 3112*a* and 3112*b* of the monoblock 3101

Stated another way, in the embodiment shown, the respective end steps 3136*a* and 3136*b* are defined in and by respective opposed end sections or regions of the monoblock 3101 having a height less than the height of the remainder of the monoblock 3101.

Stated yet another way, in the embodiment shown, the respective respective steps 3136*a* and 3136*b* each comprise a generally L-shaped recessed or notched portion of the respective end resonators 1114 and 1122 which include respective first generally horizontal surfaces 3140*a* and 3140*b* located or directed inwardly spaced from, and parallel to the horizontal exterior surface 3104 of the monoblock 3101 and respective second generally vertical surfaces or walls 3142*a* and 3142*b* located or directed inwardly of, spaced from, and parallel to, the respective side vertical exterior end surfaces 3112*a* and 3112*b* of the monoblock 3101.

Further, and although not shown or described herein in any detail, it is understood that the end steps 3136*a* and 3136*b* could also be defined by respective outwardly extending end sections or regions of the monoblock 3101 having a height greater than the height of the remainder of the monoblock 3101.

The monoblock 3101 additionally comprises a pair of electrical RF signal input/output electrodes in the form of respective through-holes 3146*a* and 3148*b* which extend through the body of the monoblocks 3101 and, more specifically, extend through the respective steps 3136*a* and 3136*b* thereof and, still more specifically, through the body of the respective end resonators 3114 and 3122 defined in the monoblock 3101 between, and in relationship generally normal to, the respective surfaces 3140*a* and 3140*b* of the respective steps 3136*a* and 3136*b* and the surface 3102 of the monoblock 3101 and further in a direction generally normal to the longitudinal axis L of the base block 3101.

Still more specifically, respective input/output through-holes 3146*a* and 3146*b* are spaced from and generally parallel to the respective transverse side end surfaces 3112*a* and 3112*b* of the monoblock 3101 and define respective generally circular openings located and terminating in the respective step surfaces 3140*a* and 3140*b* and the monoblock surface 3102.

Thus, in the embodiment shown, the through-hole 3146*a* is positioned between the end face 3112*a* and the step surface 3142*a* and the through hole 3146*b* is positioned between the end face 3112*b* and the step surface 3142*b*. Still further, in the embodiment shown, the steps 3136*a* and 3136*b* terminate at a point spaced from and short of the respective slits 3124*a* and 3124*b*.

The respective RF signal input/output through-holes 3146*a* and 3146*b* are also located and positioned in and extend through the interior of the monoblock 3101 in a relationship generally spaced from and parallel to the respective step wall or surfaces 3142*a* and 3142*b*.

All of the external surfaces 3102, 3104, 3106, 3108, 3112*a*, and 3112*b* of the monoblock 3101, the internal surfaces of the monoblock 3101 defining the respective slits or slots 3124*a*, 3124*b*, and 3124*c*, and the internal surface of the monoblock 3101 defining the respective RF signal in through-hole 3146*a* and 3146*b* are covered with a suitable conductive material, such as for example silver, with the exception of the regions described in more detail below.

The monoblock 3101 still further comprises respective RF signal input/output connectors 3400*a* and 3400*b* protruding outwardly from the respective openings 3147*a* and 3147*b* defined in the surface 3102 by the respective through-holes 3146*a* and 3146*b*.

The bridge block 3105 which, in the embodiment shown is generally rectangular in shape, is of the same width and height as the base block 3101 but less one fourth the length of the base block 3101, and is comprised of a suitable solid block of dielectric material, such as for example ceramic, includes opposed longitudinal horizontal exterior surfaces 3102*c* and 3104*c* extending in the direction of the longitudinal axis L, opposed longitudinal side vertical exterior surfaces 3106*c* and 3108*c* extending in the direction of the longitudinal axis L, and opposed transverse side vertical exterior end surfaces 3110*c* and 3112*c* extending in a direction normal to the longitudinal axis L.

The bridge block 3105 defines a resonant section 3118 (also referred to as a cavity or cell or resonator or pole).

The bridge block 3105 is coupled to and stacked on top of the base block 3101 in a relationship centrally located on the base block 3101 and overlying the central slit 3124*b* and, more specifically, in a relationship wherein a first half portion of the bridge block 3015 and the resonator 3118 defined thereby is positioned in a relationship overlapping and seated on a portion of the resonator 3120 of the base block 3101 and a second half portion of the bridge block 3105 and the resonator 3118 defined thereby is positioned in a relationship overlapping and seated on a portion of the resonator 3116 of the base block 3101. Thus, in the embodiment shown, the exterior surface 3102*c* of the bridge block 3105 is coupled to and seated against the top surface 3104 of the base block 3101.

Further, in the embodiment shown, the bridge block 3105 is coupled to the base block 3101 in a relationship wherein the vertical exterior side surface 3106*c* of the base block 3105 is vertically co-planar with the vertical exterior side surface 3106 of the base block 3101 and the opposed vertical exterior side surface 3108*c* of the bridge block 3105 is vertically co-planar with the vertical exterior side surface 3108 of the base block 3101.

Still further, in the embodiment shown, the bridge block 3105 is centrally located and seated against the top surface 3104 of the base block 3101 in a relationship and position wherein the bridge block 3105 is located between and spaced from the slits 3124*a* and 3124*c* and is seated over the central slit 3124*b* and central RF signal transmission bridge 3134.

In the embodiment shown, the waveguide filter 3100 includes an interior layer of conductive material 3560 located between the base block 3101 and the bridge block 3105 and, more specifically, an interior layer of conductive material 3560 that separates the dielectric material comprising the base block 3101 from the dielectric material comprising the bridge block 3105 and, still more specifically, an interior layer of conductive material 3560 that separates the resonator 1118 of the bridge block 3105 from the resonators 3116 and 3120 of the base block 3101.

The elements for providing direct capacitive coupling, inductive direct coupling, and inductive cross-coupling between the resonators 3114, 3116, 3118, 3120, and 3122 of the waveguide filter 3100 will now be described in more detail.

Initially, waveguide filter 3100 comprises a first means for providing a direct capacitive RF signal coupling or transmission between the resonator 3116 of the base block 3101 and the resonator 3118 of the bridge block 3105 and a second means for providing a direct inductive RF signal coupling or transmission between the resonator 3118 of the bridge block 3106 and the resonator 3120 of the base block 3131 comprising respective interior windows 3560*a* and 3560*b* and an interior window 3560*c* in the interior of the waveguide filter 3100 and, more specifically respective regions 3560*a*, 3560*b*, and 3560*c* in the layer of conductive material 3560 which are devoid of conductive material, regions of dielectric material in which the dielectric material of the base block 3101 is in contact with the dielectric material of the bridge block 3105.

Moreover, it is understood that the respective interior windows 3560*a*, 3560*b*, and 3560*c* are defined by respective regions in the exterior layer of conductive material covering the respective exterior surfaces 3104 and 3102*c* of the respective blocks 3101 and 3105 that are devoid of conductive material and which are respectively aligned with each other when the bridge block 3105 is coupled to the base block 3101 during the assembly of the waveguide filter 3100.

In the embodiment shown, the internal windows 3560*a* and 3560*b* that provide and define a capacitive direct coupling RF signal transmission path are: generally rectangular in shape; defined and located in the region of the interior layer of conductive material 3560 overlying the resonator 3116 of the base block 3101; are both positioned on the same side as and in a relationship spaced and generally normal to the central slit 3124*b* of the base block 3101; and positioned on opposites sides of and spaced from and generally parallel to the longitudinal axis L of the base block 3101. Thus, in the embodiment shown, the internal window 3560*a* is located between, and in relationship spaced from and generally parallel to, the external longitudinal surface 3106 and the longitudinal axis L of the base block 3101; and the internal window 3560*b* is located between, and in a relationship spaced from and generally parallel to, the opposed longitudinal surface 3108 and the longitudinal axis L of the base block 3101.

In the embodiment show, the internal window 3560*c* that provides and defines an inductive direct coupling RF signal transmission path is: generally rectangular in shape; defined and located in the region of the interior layer of conductive material 3560 overlying the resonator 3120 of the base block 3101; positioned on the opposite side of and in a relationship spaced and generally parallel to the central slit 3124*b* of the base block 3101; positioned in a relationship normal to and intersecting the longitudinal axis L of the base block 3101; and is positioned and direction generally normal to the direction of the internal windows 3560*a* and 3560*b*.

In accordance with the invention, an RF signal is transmitted through the waveguide filter 3100 as now described in more detail.

Initially, and where the connector 3400*a* is the RF signal input connector, the RF signal is transmitted initially into the step 3136*a* and directly through the resonator 3114 of the base block 3101; then directly into the resonator 1116 in the base block 3101 via the direct coupling path $d_1$ and through the direct coupling RF signal bridge of dielectric material 3128 defined in the base block 3101 between the resonators 3114 and 3116; then from the resonator 3116 of the base block 3101 into the resonator 3118 in the badge block 3105 via and through the pair of direct capacitive coupling paths $d_2$ defined by the respective interior RF signal transmission window 3560*a* and 3560*b* and also from the resonator 3316 of the base block into the resonator 3120 of the base block 3101 via the inductive cross-coupling path c defined by the RF signal bridge of dielectric material 3134 defined in the base block 3101 between the resonators 3116 and 3120; then also from the resonator 3118 of the bridge block 3105 and into the resonator 3116 of the base block 3101 via and through the inductive direct coupling path $d_3$ defined by the interior RF signal transmission window 3560*c*; then into the resonator 3114 via the direct coupling path $d_4$ and through the direct coupling RF signal bridge of dielectric material 3135 defined in the base block 3101 between the resonators 3120 and 3122; and then into the step 1136*b* in the base block 3101; and then out through the output connector 1400*b*.

Thus in the embodiment shown, and by virtue of the offset, raised, bridging relationship of the bridge block 3105 relative to the base block 3101, the bridge block 3105 and the resonator 3118 thereof are positioned in a relationship and horizontal plane that is offset and parallel to the horizontal plane in which the base block 3101 and the resonators 3114, 3116, 3120, and 3122 thereof and further the RF signal transmission and coupling paths $d_2$ and $d_3$ are oriented and extend in a direction generally normal to the coupling paths $d_1$, c, and $d_4$.

The performance of the waveguide filter 3100 is shown in FIG. 9 which shows the notch and RF signal transmission shunt zero that is created below the passband as a result of the transmission of the RF signal through the base block 3101, the bridge block 3105, and internal RF signal transmission windows 3560*a*, 3560*b*, and 3660*c* as described above.

Figure 7:
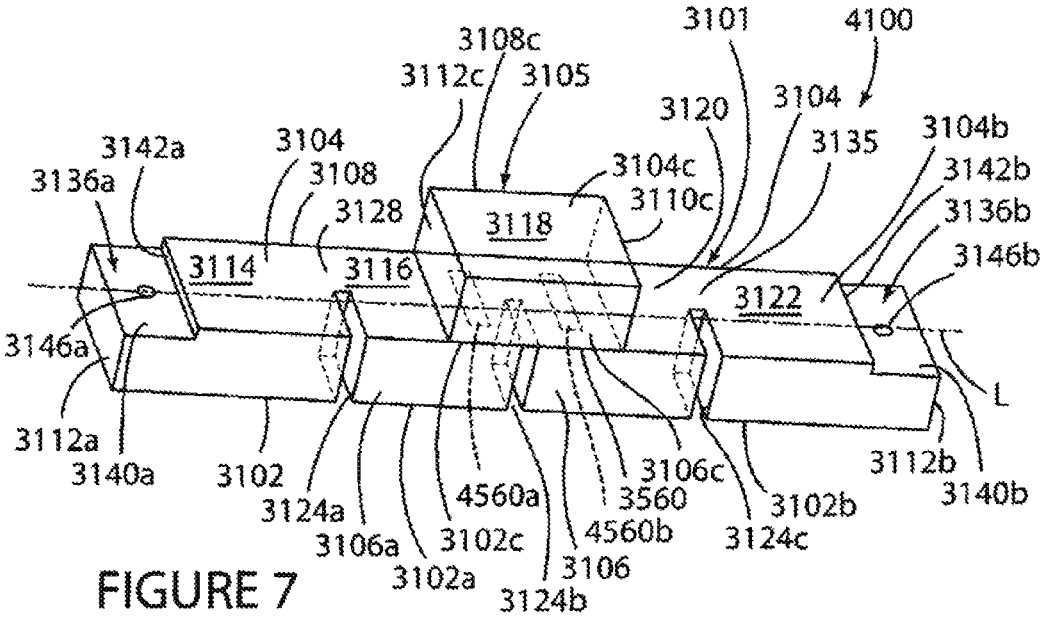
FIG. 7 is an enlarged top perspective view of yet a further embodiment of a dielectric waveguide filter according to the present invention.
Figure 8:
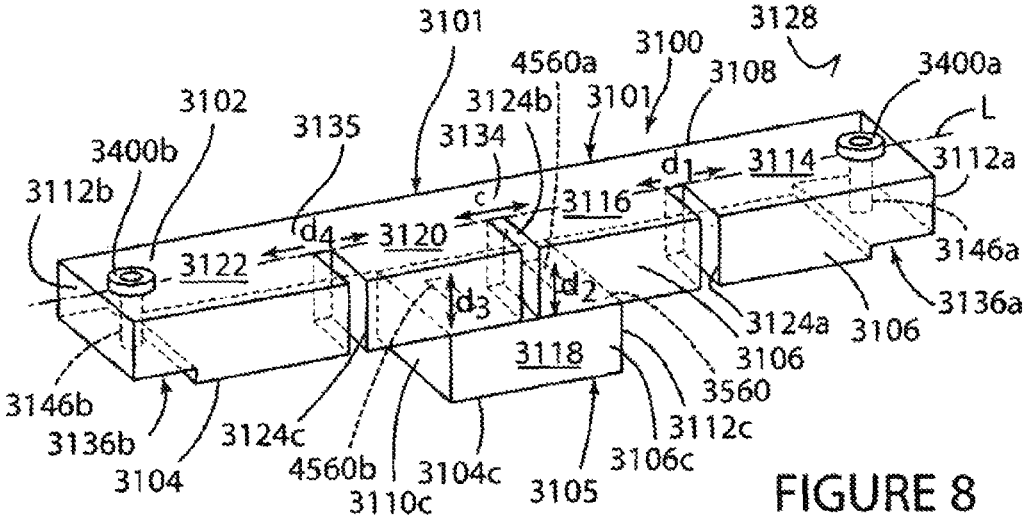
FIG. 8 is an enlarged bottom perspective view of the dielectric waveguide filter according to the present invention.

FIGS. 7 and 8 depict another embodiment of a waveguide filter 4100 in accordance with the present invention in which the majority of the elements thereof are identical in structure and function to the elements of the waveguide filter 4100 except as otherwise described below. As a result, the elements of the waveguide filters 3100 and 4100 which are identical in structure and function have been identified with the same numerals in FIGS. 5, 6, 7, and 8 and thus the earlier description of the structure and function of such elements with respect to the waveguide filter 3100 shown in FIGS. 5 and 6 is incorporated herein by reference with respect to the waveguide filter 4100 shown in FIGS. 7 and 8 except as otherwise discussed below in more detail.

Specifically, the waveguide filter 4100 differs in structure from the waveguide filter 3100 only in that the direct coupling between the resonators 3116 and 3120 of the base block 3101 and the resonator 3118 of the bridge block 3105 is provided via direct inductive coupling paths $d_2$ and $d_3$ defined by a pair of internal generally parallel windows 4560*a* and 4560*b*, rather than three internal windows 3560*a*, 3560*b*, and 3560*c* as in the waveguide filter 3100, that have been arranged and positioned in the interior of the waveguide filter 4100 as described in more detail below.

Still more specifically, waveguide filter 4100 comprises a first means for providing a direct RF signal coupling or transmission between the resonator 3116 of the base block 3101 and the resonator 3118 of the bridge block 3105 and a second means for providing a direct RF signal coupling or transmission between the resonator 3118 of the bridge block 3105 and the resonator 3120 of the base block 3101 in the form of respective interior windows 4560*a* and 4560*b* in the interior of the waveguide filter 4100 and, more specifically respective regions 4560*a* and 4560*b* in the interior layer of conductive material located between the base block 3101 and the bridge block 3105 which are devoid of conductive material, i.e., regions of dielectric material in which the dielectric material of the base block 3101 is in contact with the dielectric material of the bridge block 3105.

Moreover, it is understood that the respective interior windows 4560*a* and 4560*b* are defined by respective regions in the exterior layer of conductive material covering the respective exterior surfaces 3104 and 3102*c* of the respective blocks 3101 and 3105 that are devoid of conductive material and which are respectively aligned with each other when the bridge block 3105 is coupled to the base block 3101 during the assembly of the waveguide filter 4100.

In the embodiment shown, the internal window 4560*a* is: generally rectangular in shape; defined and located in the region of the interior layer of conductive material 3560 overlying the resonator 3115 of the base block 3101; positioned on one side of and in a relationship spaced and generally parallel to the central slit 3124*b* of the base block

3101; and positioned in a relationship generally normal to and intersecting the longitudinal axis L of the base block 3101.

In the embodiment shown, the internal window 4560*b* is generally rectangular in shape; defined and located in the region of the interior layer of conductive material 3560 overlying the resonator 3120 of the base block 3101; positioned on the other side of and in a relationship spaced and generally parallel to the central slit 3124*b* of the base block 3101; positioned in a relationship generally normal to and intersecting the longitudinal axis L of the base block 3101; and positioned in a relationship spaced and parallel to the internal window 4560*a*.

In accordance with the invention, an RF signal is transmitted through the waveguide filter 4100 as now described in more detail.

Initially, and where the connector 3400*a* is the RF signal input connector, the RF signal is transmitted initially into the step 3136*a* and directly through the resonator 3114 of the base block 3101; then directly into the resonator 1116 in the base block 3101 via the direct coupling path $d_1$ and through the direct coupling RF signal bridge of dielectric material 3128 defined in the base block 3101 between the resonators 3114 and 3116; then from the resonator 3116 of the base block 3101 into the resonator 3118 in the bridge block 3105 via and through the direct inductive coupling path $d_2$ defined by the interior RF signal transmission window 4560 and also into the resonator 3120 via the inductive cross-coupling path c defined by the RF signal bridge of dielectric material 3134 defined in the base block 3101 between the resonators 3116 and 3120; then also from the resonator 1118 of the bridge block 3105 and into the resonator 3116 of the base block 3101 via and through the direct inductive coupling path $d_3$ defined by the interior RF signal transmission window 4560*b*; then into the resonator 3114 via the direct coupling path $d_4$ and through the direct coupling signal bridge of dielectric material 3135 defined in the base block 3101 between the resonators 3120 and 3122; and then into the step 1136*b* in the base block 3101; and then out through the output connector 1400*b*.

The performance of the waveguide filter 4100 is shown in FIG. 10 which shows the notch and RF signal transmission shunt zero that is created above the passband as a result of the transmission of the RF signal through the base block 3101, the bridge block 3105, and internal RF signal transmission windows 4560*a* and 4560*b* as described above.

While the invention has been taught with specific reference to the embodiment shown, it is understood that a person of ordinary skill in the art will recognize that changes can be made in form and detail without departing from the spirit and the scope of the invention. The described embodiments are to be considered in all respects only as illustrative and not restrictive.

For example, it is understood that the invention encompasses other waveguide filter embodiments in which for example: the base blocks include no steps; the base blocks include additional slits; the bridge block includes slits; the base blocks and/or bridge blocks are of different configuration, shape, size, length, width, or height; the waveguide fitter includes additional base and/or bridge blocks; and in which the size, configuration, location, orientation, and number of internal RF signal transmission windows is varied depending upon the particular application or desired performance.

We claim:

1. A waveguide filter adapted for transmission of an RF signal comprising:

a first separate and solid block of dielectric material covered with a first layer of conductive material and defining a first resonator and a first path for the transmission of the RF signal;

a second separate and solid block of dielectric material covered with a second layer of conductive material and defining a second resonator and a second path for the transmission of the RF signal;

a separate and solid bridge block of dielectric material covered with a third layer of conductive material and defining a third resonator and a third path for the transmission of the RF signal, the first and second blocks and the bridge block being coupled to each other along respective exterior surfaces thereof in an abutting relationship wherein the bridge block bridges the first and second blocks and defining a first interior layer of conductive material between the first block and the bridge block and the second block and the bridge block;

a first interior RF signal transmission window defined in a first region of the first interior layer of conductive material between the first block and the bridge block and defining a fourth path for the transmission of the RF signal between the first block and the bridge block;

a second interior RF signal transmission window defined in a second region of the first interior layer of conductive material between the second block and the bridge block and defining a fifth path for the transmission of the RF signal between the second block and the bridge block; and wherein the fourth and fifth paths for the transmission of the RF signal are normal to the first, second, and third paths for the transmission of the RF signal.

2. A waveguide filter adapted for transmission of an RF signal comprising:

a first separate and solid block of dielectric material covered with a first layer of conductive material and defining at least a pair of first resonators separated by a first slit formed in the first solid block of dielectric material and a first path for the transmission of the RF signal;

a second separate and solid block of dielectric material covered with a second layer of conductive material and defining at least a pair of second resonators separated by a second slit formed in the second solid block of dielectric material and a second path for the transmission of the RF signal;

a separate and solid bridge block of dielectric material covered with a third layer of conductive material and defining at least a third resonator, the first and second blocks and the bridge block being coupled to each other along respective exterior surfaces thereof in an abutting relationship wherein the bridge block bridges the first and second blocks and defining a first interior layer of conductive material between the first block and the bridge block and the second block and the bridge block;

a first interior RF signal transmission window defined in a first region of the first interior layer of conductive material between the first block and the bridge block and defining a third path for the transmission of the RF signal between one of the first pair of resonators and the at least third resonator in a direction normal to the first and second paths; and a second interior RF signal transmission window defined in a second region of the first interior layer of conductive material between the second block and the bridge block and defining a second path for the transmission of the RF signal between the at least third resonator and one of the pair of second resonators in a direction normal to the first and second paths.

3. A waveguide filter adapted for transmission of an RF signal comprising:

a first block of dielectric material covered with a first layer of conductive material and defining at least a first resonator and a first path for the transmission of the RF signal;

a second block of dielectric material covered with a second layer of conductive material and defining at least a second resonator and a second path for the transmission of the RF signal;

a third block of dielectric material covered with a third layer of conductive material and defining at least a third resonator and a third path for the transmission of the RF signal, the third block of dielectric material being coupled to and bridging the first and second blocks of dielectric material;

a first interior RF signal transmission window defined between the first block and the third block and defining a fourth path for the transmission of the RF signal between the first block and the third block in a direction normal to the first and second paths;

a second interior RF signal transmission window defined between the first block and the third block and defining a fifth path for the transmission of the RF signal between the first block and the third block in a direction normal to the first, second, and third paths; and a third interior RF signal transmission window defined between the second block and the third block and defining a sixth path for the transmission of the RF signal between the second block and the third block in a direction normal to the first, second, and third paths.

* * * * *